US009076410B2

(12) United States Patent
Shinmachi

(10) Patent No.: US 9,076,410 B2
(45) Date of Patent: Jul. 7, 2015

(54) FALLBOARD ARRANGEMENT FOR KEYBOARD INSTRUMENT AND OPENING AND CLOSING DEVICE FOR FALLBOARD

(71) Applicant: KABUSHIKI KAISHA KAWAI GAKKI SEISAKUSHO, Hamamatsu-shi, Shizuoka-ken (JP)

(72) Inventor: Seisaku Shinmachi, Hamamatsu (JP)

(73) Assignee: KABUSHIKI KAISHA KAWAI GAKKI SEISAKUSHO, Hamamatsu-shi (JP)

( * ) Notice: Subject to any disclaimer, the term of this patent is extended or adjusted under 35 U.S.C. 154(b) by 0 days.

(21) Appl. No.: 14/480,455

(22) Filed: Sep. 8, 2014

(65) Prior Publication Data

US 2015/0075350 A1 Mar. 19, 2015

(30) Foreign Application Priority Data

Sep. 19, 2013 (JP) ..... 2013-194023
Sep. 27, 2013 (JP) ..... 2013-201220

(51) Int. Cl.
*G10C 3/02* (2006.01)

(52) U.S. Cl.
CPC ..... *G10C 3/02* (2013.01)

(58) Field of Classification Search
CPC ..... G10C 3/02
See application file for complete search history.

(56) References Cited

U.S. PATENT DOCUMENTS

| | | | | |
|---|---|---|---|---|
| 1,498,955 | A * | 6/1924 | Dinsmore | 84/180 |
| 2,113,045 | A * | 4/1938 | Evans | 84/174 |
| 5,175,386 | A * | 12/1992 | Kuwahara | 84/179 |
| 5,837,911 | A * | 11/1998 | Inoue | 84/179 |
| 6,686,521 | B2 * | 2/2004 | Sandifer | 84/179 |
| 7,550,658 | B2 * | 6/2009 | Suzuki et al. | 84/179 |
| 8,088,983 | B2 * | 1/2012 | Nakamura | 84/179 |
| 8,916,757 | B2 * | 12/2014 | Tsuchimoto et al. | 84/179 |

FOREIGN PATENT DOCUMENTS

| | | |
|---|---|---|
| JP | 09-319357 | 12/1997 |
| JP | 2003-177738 | 6/2003 |

* cited by examiner

*Primary Examiner* — Robert W Horn
(74) *Attorney, Agent, or Firm* — Christie, Parker & Hale, LLP

(57) ABSTRACT

A fallboard arrangement for a keyboard instrument, which makes it possible to make flat the entire upper surface of a keyboard instrument in a closed state. A fallboard back section is immovably provided in a rear part of the body, in a horizontal state. A fallboard is movable between a closed position where it is forward of the fallboard back section and has an upper surface thereof made flush with that of the fallboard back section in a state closing the performance section and an open position where it is upward of the fallboard back section so as to open the performance section. A hinge connects the fallboard to the fallboard back section in a manner pivotally movable between the closed position and the open position and is disposed downward of the fallboard in the closed position and the upper surface of the fallboard back section.

5 Claims, 9 Drawing Sheets

FALLBOARD ARRANGEMENT FOR KEYBOARD INSTRUMENT AND OPENING AND CLOSING DEVICE FOR FALLBOARD

CROSS-REFERENCE TO RELATED APPLICATION(S)

This application claims priority to and the benefit of Japanese Patent Application No. 194023/2013, filed on Sep. 19, 2013 and Japanese Patent Application No. 201220/2013, filed Sep. 27, 2013, the disclosures of which are hereby incorporated by reference in their entirety.

BACKGROUND OF THE INVENTION

1. Field of the Invention

The present invention relates to a fallboard arrangement for a keyboard instrument, which is applied to a keyboard instrument, such as an electronic piano, the keyboard instrument having a fallboard configured to pivotally move to open and close a performance section including a keyboard, and an opening and closing device for a fallboard, which is configured to open and close a fallboard attached to a musical instrument body in a manner pivotally movable between a fully-open position for opening a keyboard and a fully-closed position for closing the keyboard.

2. Description of the Related Art

Conventionally, there has been known a fallboard arrangement of this type disclosed e.g. in Japanese Laid-Open Patent Publication (Kokai) No. 2003-177738 filed by the present applicant. The fallboard arrangement, which is applied e.g. to an upright piano, includes a fallboard back section, and a fallboard pivotally connected to a front end of the fallboard back section via a hinge to open and close a keyboard. Note that the fallboard arrangement is provided with a rotary dumper and a link mechanism connecting between the rotary dumper and the fallboard, so as to brake the pivotal motion of the fallboard in the closing direction using the rotary dumper and the link mechanism.

FIG. 9A shows the above-mentioned conventional fallboard arrangement. As shown in FIG. 9A, in the fallboard arrangement 41, the hinge, denoted by a reference numeral 44, is mounted in a manner sandwiched between a front end face (left end face as viewed in FIG. 9A) of the fallboard back section, denoted by a reference numeral 42, and a rear end face (right end face as viewed in FIG. 9A) of the fallboard, denoted by a reference numeral 43. As shown in FIG. 9B, the hinge 44 is comprised of a fallboard back section-side fixed plate 45 and a fallboard-side fixed plate 46 each having one end (upper end as viewed in FIG. 9B) thereof formed with an associated one of hollow cylindrical connection tubes 45*a* and 46*a*, and a connection shaft 47 inserted through the connection tubes 45*a* and 46*a* for connection of the two fixed plates 45 and 46. The fallboard back section-side fixed plate 45 of the hinge 44 is rigidly secured to the front end face, denoted by a reference numeral 42*a*, of the fallboard back section 42 with screws 48, and the fallboard-side fixed plate, denoted by a reference numeral 46, is rigidly secured to the rear end face, denoted by a reference numeral 43*a*, of the fallboard 43 with screws (hereinafter referred to as "the long screws") 49 which are longer than the fallboard back section-side screws 48.

More specifically, as for the fallboard-side fixed plate 46 of the hinge 44, the long screws 49 and a metal plate 50 having screw holes 50*a* are used to securely fix the fixed plate 46 to the fallboard 43. Further more specifically, the metal plate 50 is embedded in the fallboard 43 at a predetermined location, and holes 43*b* are formed in the fallboard 43 in a manner extending from the rear end face 43*a* of the fallboard 43 to the metal plate 50. Then, the long screws 49 are screwed into the screw holes 50*a* of the metal plate 50 from the side of the rear end face 43*a* of the fallboard 43 via the holes 43*b*, respectively. This causes the fallboard 43 to be fastened in a state held between the fallboard-side fixed plate 46 of the hinge 44 and the metal plate 50, whereby the fallboard 43 is securely connected to the fallboard back section 42 via the hinge 44. When the front end of the fallboard 43 is lifted, the fallboard 43 is pivotally moved about the hinge 44, as shown in FIG. 10, to be opened.

In the above-described fallboard arrangement, when the fallboard 43 is closed, the upper surface of the fallboard 43 and that of the fallboard back section 42 become horizontally flush with each other. In this case, however, the connection shaft 47 of the hinge 44 and the connection tubes 45*a* and 46*a* of the respective fixed plates 45 and 46 connected by the connection shaft 47 project upward from between the fallboard 43 and fallboard back section 42, and hence a good appearance cannot be obtained. Further, when a user of the piano wants to open e.g. a music book or a notebook on the fallboard 43 in a closed state thereof and write something on it, the portion of the hinge 44 projecting upward can become an obstacle.

As the opening and closing device for a fallboard of the above-mentioned type, there has conventionally been known one disclosed e.g. in Japanese Laid-Open Patent Publication (Kokai) No. H09-319357. The opening and closing device is comprised of a single rotary damper and a single link mechanism. The rotary damper is configured to cause the rotor to generate a braking force irrespective of the direction of rotation of the rotor, and the braking force is set to be larger in the clockwise rotation of the rotor than in the counterclockwise rotation of the same. The link mechanism is configured to transmit the pivotal motion of the fallboard to the rotary damper as well as to transmit the braking force of the rotary dumper to the fallboard. When the fallboard pivotally moves from a predetermined position between the fully closed position and the fully open position toward the fully open position, and when the fallboard rotates from the predetermined position toward the fully closed position, the rotor is caused to perform clockwise rotation by transmission of the pivotal motion of the fallboard via the link mechanism, and in the other cases, the rotor rotates in the counterclockwise direction.

As a consequence, in the conventional opening and closing device, when the fallboard pivotally moves from the predetermined position toward the fully open position or from the predetermined position toward the fully closed position, the rotary damper transmits a larger braking force to the fallboard via the link mechanism than in the other cases. This makes it possible to prevent the fallboard from strongly colliding against the upper panel of the keyboard instrument when the fallboard is opened or from colliding against the keyslip of the keyboard instrument when the fallboard is closed.

However, since the conventional opening and closing device uses only the single rotary damper as described above, it is impossible to sufficiently brake the fallboard immediately before the fallboard is fully opened or closed, and therefore there still is a fear that the fallboard strongly collides against the upper panel of the keyboard instrument when the fallboard is opened or strongly collides against the keyslip of the keyboard instrument when the fallboard is closed. Further, at an initial stage of the opening or closing operation of the fallboard as well, the braking force of the rotary damper acts on the fallboard, which can hinder smooth opening or closing operation of the fallboard.

SUMMARY OF THE INVENTION

It is a first object of the present invention to provide a fallboard arrangement for a keyboard instrument, which makes it possible to make flat the entire upper surface of the keyboard instrument in a state where a fallboard is closed, to thereby obtain a smooth and good appearance.

It is a second object to provide an opening and closing device for a fallboard, which makes it possible to cause braking forces of respective first and second rotary dampers to appropriately act on the fallboard depending on the opening position of the fallboard, to thereby appropriately brake the fallboard.

To attain the above first object, in a first aspect of the present invention, there is provided a fallboard arrangement for a keyboard instrument, which is disposed in an upper part of a musical instrument body having a performance section including a keyboard, so as to close the performance section into a covered state and open the performance section into an exposed state, comprising a fallboard back section that is formed to have a board shape, and is immovably provided in a rear part of the musical instrument body, in a horizontal state, a fallboard that is movable between a closed position where the fallboard is positioned forward of the fallboard back section and has an upper surface thereof made flush with an upper surface of the fallboard back section in a state closing the performance section, and an open position where the fallboard is positioned upward of the fallboard back section and opens the performance section, and a hinge that connects the fallboard to the fallboard back section such that the fallboard can pivotally move between the closed position and the open position, wherein the hinge is disposed downward of the fallboard in the closed position and the upper surface of the fallboard back section.

With the construction of this fallboard arrangement according to the first aspect of the present invention, the fallboard arrangement is disposed in the upper part of the musical instrument body having the performance section including the keyboard. The fallboard back section of the fallboard arrangement is formed to have a board shape and is immovably provided in the rear part of the musical instrument body, in a horizontal state. The fallboard of the fallboard arrangement is connected to the fallboard back section via the hinge and opens and closes the performance section while pivotally moving between the closed position and the open position. The hinge is disposed downward of the fallboard in the closed position and the upper surface of the fallboard back section. Therefore, differently from the prior art, when the fallboard is in the closed position, the hinge does not project from between the upper surface of the fallboard and that of the fallboard back section, so that the entire upper surface of the keyboard instrument can be made flat. This makes it possible to give a smooth and good appearance to the fallboard arrangement in a state where the fallboard is closed.

Preferably, the hinge includes a fallboard back section-side fixed plate that is rigidly secured to a front end face and lower surface continuous therewith of the fallboard back section, a fallboard-side fixed plate that is rigidly secured to a fallboard back section-side end face and lower surface continuous therewith of the fallboard, and a connection shaft that extends horizontally, and connects the fallboard back section-side fixed plate and the fallboard-side fixed plate in a manner pivotally movable with respect to each other, and a fallboard back section-side end of the fallboard is provided with a cover part which is formed in a manner continuous with the upper surface of the fallboard and protruding toward the fallboard back section, the cover part being configured to cover, when the fallboard is in the closed position, from above a portion of the fallboard back section-side fixed plate and a portion of the fallboard-side fixed plate which are connected to each other by the connection shaft.

With the construction of this preferred embodiment, the fallboard back section-side fixed plate of the hinge is rigidly secured to the front end face and lower surface continuous therewith of the fallboard back section, and the fallboard-side fixed plate of the hinge is rigidly secured to the fallboard back section-side end face and lower surface continuous therewith of the fallboard, so that the hinge can be more securely fixed to the fallboard back section and the fallboard than in a case where the fixed plates are rigidly secured to respective single surfaces. Further, since the fallboard back section-side end face of the fallboard is provided with the cover part, it is possible not only to conceal the hinge from the view of a user sitting in front of the keyboard instrument, but also to reduce a gap between the fallboard and the fallboard back section, to thereby further improve the appearance of the fallboard arrangement.

More preferably, the fallboard back section has a recess provided in an upper portion of a front end thereof, the recess being so cut out as to avoid interference of the fallboard back section with the cover part during pivotal motion of the fallboard toward the open position.

With the construction of this preferred embodiment, the upper portion of the front end of the fallboard back section is provided with the recess, so that it is possible to wide open the fallboard without causing the cover part of the fallboard to interfere with the fallboard back section when the fallboard is opened.

To attain the above second object, in a second aspect of the present invention, there is provided an opening and closing device for a fallboard, for opening and closing a fallboard that is attached to a musical instrument body in a manner pivotally movable between a fully open position for opening a keyboard and a fully closed position for closing the keyboard, comprising a first rotary damper that has a rotatable first rotor, and is provided in the musical instrument body, the first rotary damper being configured to cause the first rotor to generate a braking force only during rotation of the first rotor in a predetermined first direction, a first link mechanism that is connected to the fallboard and the first rotor, and is configured to cause the first rotor to rotate in the first direction in accordance with pivotal motion of the fallboard when the fallboard pivotally moves from a predetermined first opening position between the fully open position and the fully closed position toward the fully open position or when the fallboard pivotally moves from the first opening position toward the fully closed position, a second rotary damper that has a rotatable second rotor, and is provided in the musical instrument body, the second rotary damper being configured to cause the second rotor to generate a braking force only during rotation of the second rotor in a predetermined second direction, and a second link mechanism that is connected to the fallboard and the second rotor, and is configured to cause the second rotor to rotate in the second direction in accordance with pivotal motion of the fallboard when the fallboard pivotally moves from a predetermined second opening position between the fully open position and the fully closed position, where an opening degree of the fallboard is smaller than in the first opening position, toward the fully open position or when the fallboard pivotally moves from the second opening position toward the fully closed position.

With the construction of the opening and closing device according to the second aspect of the present invention, the first rotary damper is configured to cause the first rotor to generate a braking force only during rotation of the first rotor in the first direction. Further, the first link mechanism is connected to the fallboard and the first rotor and is configured to cause the first rotor to rotate in the first direction in accordance with pivotal motion of the fallboard when the fallboard pivotally moves from the first opening position toward the fully open position or when the fallboard pivotally moves from the first opening position toward the fully closed position. The braking force of the first rotary damper generated by the rotation of the first rotor is transmitted to the fallboard via the first link mechanism. On the other hand, the second rotary damper is configured to cause the second rotor to generate a braking force only during rotation of the second rotor in the second direction. The second link mechanism is connected to the fallboard and the second rotor and is configured to cause the second rotor to rotate in the second direction in accordance with pivotal motion of the fallboard when the fallboard pivotally moves from the second opening position where the opening degree of the fallboard is smaller than in the first opening position toward the fully open position or when the fallboard pivotally moves from the second opening position toward the fully closed position. The braking force of the second rotary damper generated by the rotation of the second rotor is transmitted to the fallboard via the second link mechanism.

As is apparent from the above-described operation, the first and second rotors do not rotate in the respective first and second directions when the fallboard pivotally moves from the fully closed position toward the second opening position, and therefore neither of the braking forces of the respective first and second rotary dampers acts on the fallboard. Further, when the fallboard pivotally moves from the second opening position toward the first opening position where the degree of opening of the fallboard is larger than in the second opening position, only the braking force of the second rotary damper acts on the fallboard, and when the fallboard pivotally moves from the first opening position toward the fully open position, not only the braking force of the second rotary damper, but also the braking force of the first rotary damper acts on the fallboard. Further, when the fallboard pivotally moves from the fully open position to the first opening position, the first and second rotors do not rotate in the respective first and second directions, and therefore neither of the braking forces of the respective first and second rotary dampers acts on the fallboard. Then, when the fallboard pivotally moves from the first opening position toward the second opening position where the degree of opening of the fallboard is smaller than in the first opening position, only the braking force of the first rotary damper acts on the fallboard, and when the fallboard pivotally moves from the second opening position toward the fully closed position, not only the braking force of the first rotary damper, but also the braking force of the second rotary damper acts on the fallboard.

As described above, differently from the prior art described hereinbefore, it is possible to cause both the braking forces of the respective first and second rotary dampers to act on the fallboard, so that the fallboard can be sufficiently braked. In doing this, the braking forces of the respective first and second rotary dampers are not both caused to act on the fallboard from the start of the opening or closing operation of the fallboard, but only one of the two braking forces is caused to act first, and then both the two braking forces are caused to act. This enables stepwise increase of the braking force acting on the fallboard e.g. even when the fallboard is abruptly opened or closed, which makes it possible to prevent breakage of the fallboard and/or the first and second link mechanisms due to sudden action of a very large braking force generated by the abrupt opening or closing.

Further, neither of the braking forces of the respective first and second rotary dampers is caused to act on the fallboard at the start of the opening or closing operation of the fallboard, so that the opening or closing operation of the fallboard can be performed smoothly. The above-described advantageous effects can be obtained by using general one-way dampers instead of using expensive rotary dampers capable of changing their braking forces.

Preferably, the first link mechanism includes a first link rigidly secured to the fallboard, a second link pivotally connected to the first link, and a third link pivotally connected to the second link and rigidly secured to the first rotor, the second link mechanism including a fourth link rigidly secured to the fallboard, a fifth link pivotally connected to the fourth link, and a sixth link pivotally connected to the fifth link and rigidly secured to the second rotor, each pair of the first link and the fourth link, the second link and the fifth link, and the third link and the sixth link being configured to each have the same shape and size, wherein the first and second rotary dampers have the same construction.

With the construction of this preferred embodiment, since the first link and the fourth link have the same shape and size, it is possible to commonly use the same mold for manufacturing the two links, for example, so that the manufacturing costs of the device can be reduced. Similarly, each pair of the second link and the fifth link and the third link and the sixth link each have the same shape and size, so that the manufacturing costs of the device can be further reduced. Further, since the first and second rotary dampers have the same construction, it is possible to employ inexpensive rotary dampers for the two rotary dampers to thereby further reduce the manufacturing costs of the device.

The above and other objects, features, and advantages of the present invention will become more apparent from the following detailed description taken in conjunction with the accompanying drawings.

BRIEF DESCRIPTION OF THE DRAWINGS

FIGS. 1A and 1B are views of an electronic piano to which is applied a fallboard arrangement according to a first embodiment of the present invention, in a state where a performance section is closed, in which:

FIG. 1A is a schematic side view of the appearance and internal construction of a piano body; and FIG. 1B is an enlarged view of a hinge of the fallboard arrangement shown in FIG. 1A and components therearound.

FIGS. 2A and 2B are views of the electronic piano shown in FIGS. 1A and 1B, in a state where the performance section is open, in which:

FIG. 2A is a schematic side view similar to FIG. 1A; and

FIG. 2B is an enlarged view similar to FIG. 1B.

FIGS. 9A and 9B are views of a conventional fallboard arrangement, in which:

FIG. 9A is a schematic side view of the conventional fallboard arrangement; and FIG. 9B is an enlarged view of a hinge of the fallboard arrangement and components therearound.

DETAILED DESCRIPTION OF PREFERRED EMBODIMENTS

Figure 1A:
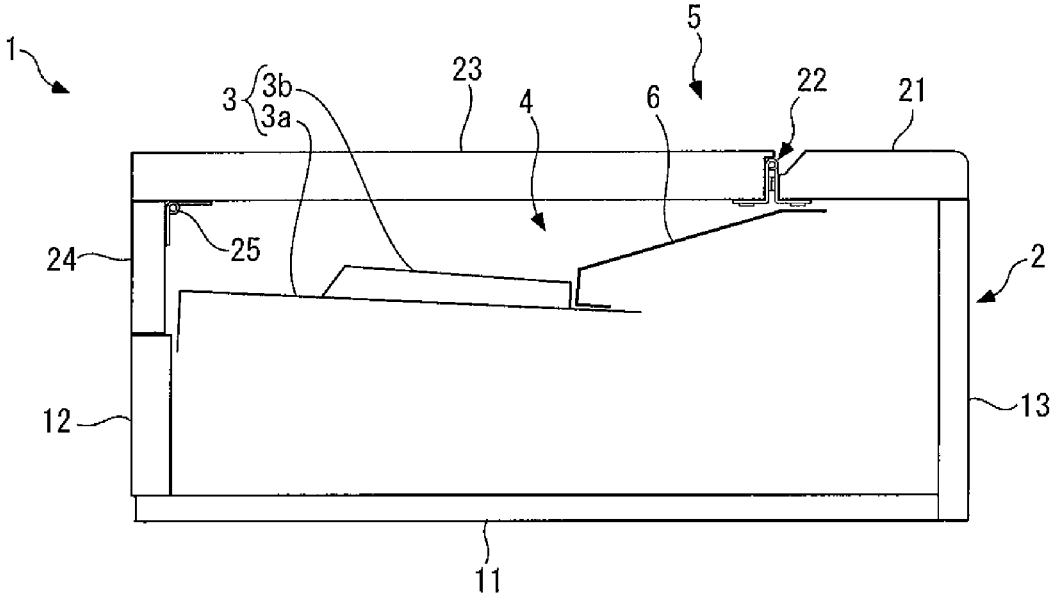
Figure 1B:
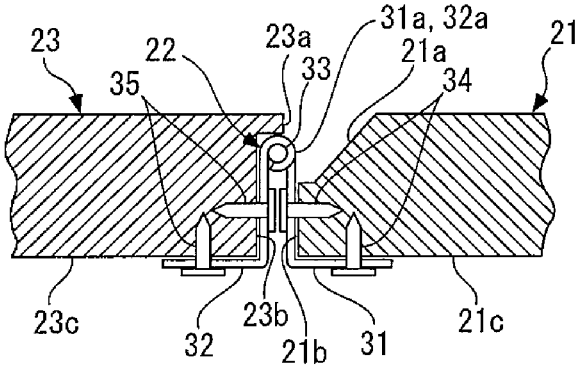

The present invention will now be described in detail with reference to the drawings showing preferred embodiments thereof. FIGS. 1A and 1B shows a piano body of an electronic piano to which is applied a fallboard arrangement according to a first embodiment of the present invention. As shown in FIG. 1A, the piano body 1 (musical instrument body) is comprised of an exterior casing 2 that encloses the piano body 1, a performance section 4 including a keyboard 3 which is disposed slightly toward the front side (left side, as viewed in FIG. 1A) within the exterior casing 2, and the fallboard arrangement 5 provided in the top of the piano body 1 and configured to close the performance section 4 into a covered state and open the same into an exposed state.

The exterior casing 2 is formed by a keybed 11 having a laterally elongated rectangular shape, in plan view, extending in the left-right direction (depth direction as viewed in FIG. 1A), a keyslip 12 and a backboard 13 erected on the respective front and rear ends of the keybed 11, left and right side boards (not shown) erected on the respective left and right ends of the keybed 11, and so forth.

The performance section 4 is comprised of the keyboard 3 having a large number of white keys 3*a* and black keys 3*b* arranged in parallel with each other in the left-right direction, an operation panel 6 disposed above the rear of the keyboard 3 in a manner sloping forward and downward and having a plurality of switches and buttons (none of which are shown) provided thereon for executing various functions for performance.

The fallboard arrangement 5 is comprised of a Tailboard back section 21 covering the rear part of the piano body 1, and a fallboard 23 connected to a front end of the fallboard back section 21 via a hinge 22. Each of the fallboard back section 21 and the fallboard 23 is formed of a board member made of a wood material and having a predetermined thickness. The fallboard back section 21 is formed into a laterally elongated rectangular shape in plan view. The fallboard back section 21 is horizontally placed on the upper surfaces of the left and right side boards and the backboard 13 and immovably fixed thereto. The front end of the fallboard back section 21 has an upper half thereof cut out to provide a recess 21*a* for avoiding interference of the fallboard back section 21 with a cover part 23*a*, referred to hereinafter, of the fallboard 23 when the fallboard 23 is opened.

On the other hand, the fallboard 23 is formed into a laterally elongated rectangular shape, in plan view, having approximately the same width as that of the fallboard back section 21 and a considerably larger depth than that of the fallboard back section 21. A board-like front section 24 having a predetermined height is connected to the lower front end face of the fallboard 23 via a hinge 25. Further, an upper portion of a rear end of the fallboard 23 is provided with the cover part 23*a* protruding by a predetermined length toward the fallboard back section 21 located rearward of the fallboard 23 to cover a connection shaft 33 and connection tubes 31*a* and 32*a*, described hereinafter, of the hinge 22.

The hinge 22 is formed by a fallboard back section-side fixed plate 31 rigidly secured to the front end of the fallboard back section 21, a fallboard-side fixed plate 32 rigidly secured to the rear end of the fallboard 23, the connection shaft 33 pivotally connecting between the two fixed plates 31 and 32. The two fixed plates 31 and 32 are formed of a predetermined metal plate. Each of the two fixed plates 31 and 32 extends in the left-right direction as viewed in FIG. 1B by a predetermined length, and is formed into an L shape in side view. The connection shaft 33 is inserted into the hollow cylindrical connection tubes 31*a* and 32*a* formed at the respective one ends of the fixed plates 31 and 32. The fallboard back section-side fixed plate 31 of the hinge 22 is rigidly secured to a front end face 21*b* and lower surface 21*c* continuous therewith of the fallboard back section 21, with screws 34 and 34. On the other hand, the fallboard-side fixed plate 32 is rigidly secured to a rear end face 23*b* and lower surface 23*c* continuous therewith of the fallboard 23, with screws 35 and 35. The screws 34 and 35 are screwed into the fallboard back section 21 and the fallboard 23, respectively, at a plurality of locations properly spaced from each other along the lengthwise direction (depth direction as viewed in FIGS. 1A and 1B) of the fixed plates 31 and 32.

Although not shown in FIGS. 1A and 1B, the piano body 1 is provided with a fallboard opening and closing device which has predetermined rotary dampers and links, and the fallboard 23 is braked by the fallboard opening and closing device immediately before being pivotally moved to the fully open position or to the fully closed position.

Figure 2A:
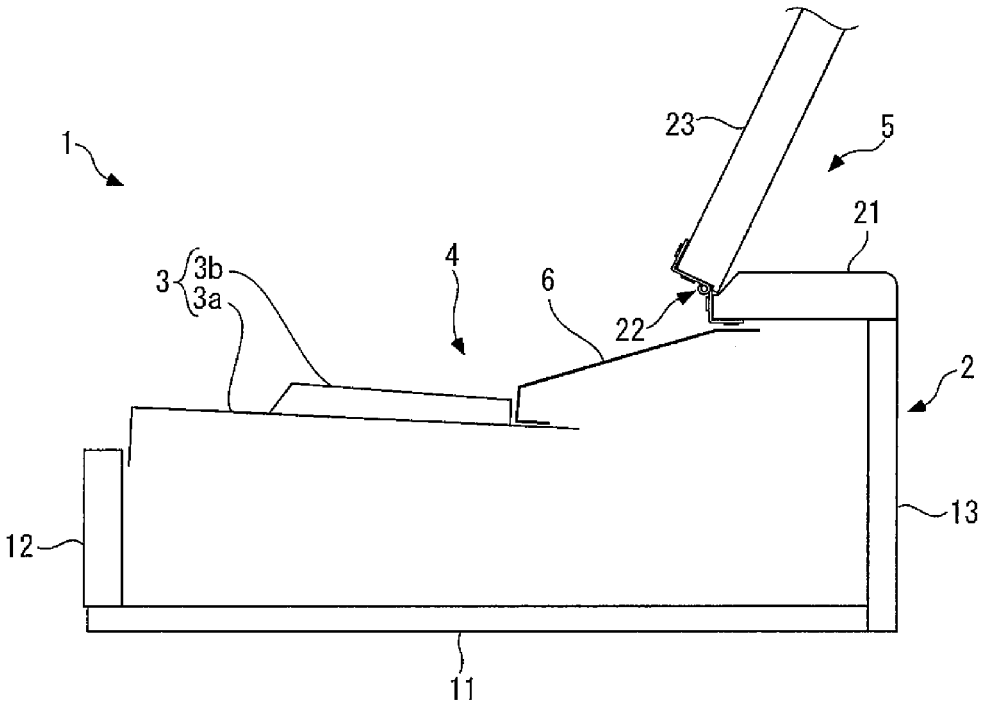
Figure 2B:
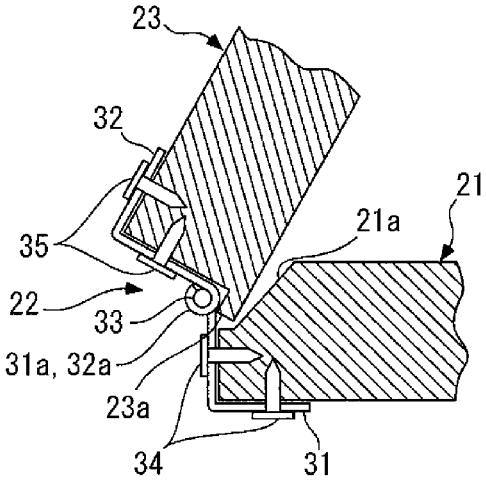

In the fallboard arrangement 5 constructed as above, the fallboard 23 opens or closes while pivotally moving about the hinge 22 (connection shaft 33) between a closed position (position shown in FIGS. 1A and 1B) where the fallboard 23 has closed the performance section 4 into a covered state and an open position (position shown in FIGS. 2A and 2B) where the fallboard 23 has opened the performance section 4 into an exposed state. When the fallboard 23 is in the closed position, the upper surface of the fallboard 23 and that of the fallboard back section 21 are held horizontally flush with each other, as shown in FIGS. 1A and 1B, and the cover part 23*a* of the rear end of the fallboard 23 is in a state covering the connection shaft 33 of the hinge 22 and the connection tubes 31*a* and 32*a* from above. On the other hand, when the fallboard 23 is in the open position, the cover part 23*a* of the rear end of the fallboard 23 is received in the recess 21*a* provided in the upper portion of the front end of the fallboard back section 21, which prevents the fallboard 23 from interfering with the fallboard back section 21.

As described above in detail, according to the present embodiment, the hinge 22 for connection between the fallboard 23 and the fallboard back section 21 is positioned below the upper surfaces of the fallboard 23 in the closed position and the fallboard back section 21. Therefore, differently from the prior art, it is possible to prevent the hinge 22 from projecting from between the upper surfaces of the fallboard 23 and the fallboard back section 21 when the fallboard 23 is in the closed position, to thereby make flat the entire upper surface of the electronic piano. This makes it possible for the fallboard arrangement 5 to have a smooth and good appearance when in the closed state of the fallboard 23.

Further, the fallboard back section-side fixed plate 31 of the hinge 22 is rigidly secured to the two surfaces of the fallboard back section 21, i.e. the front end face 21*b* and the lower surface 21*c*, and the fallboard-side fixed plate 32 is rigidly secured to the two surfaces of the fallboard 23, i.e. the rear end face 23*b* and the lower surface 23*c*, so that it is possible to fix the hinge 22 to the fallboard back section 21 and the fallboard 23 more securely than when each of the fixed plates 31 and 32 of the hinge 22 is rigidly secured to a single surface. Furthermore, since the upper portion of the rear end of the fallboard 23 is provided with the cover part 23*a*, it is possible not only to conceal the hinge 22 from the view of a user sitting in front of the electronic piano in a state where the fallboard 23 is closed, but also to reduce the gap between the fallboard 23 and the fallboard back section 21, to thereby further improve the appearance of the fallboard arrangement 5.

In addition, the upper portion of the front end of the fallboard back section 21 is provided with the recess 21*a*, so that it is possible to wide open the fallboard 23 without causing interference between the cover part 23*a* of the fallboard 23 and the fallboard back section 21.

Figure 3:
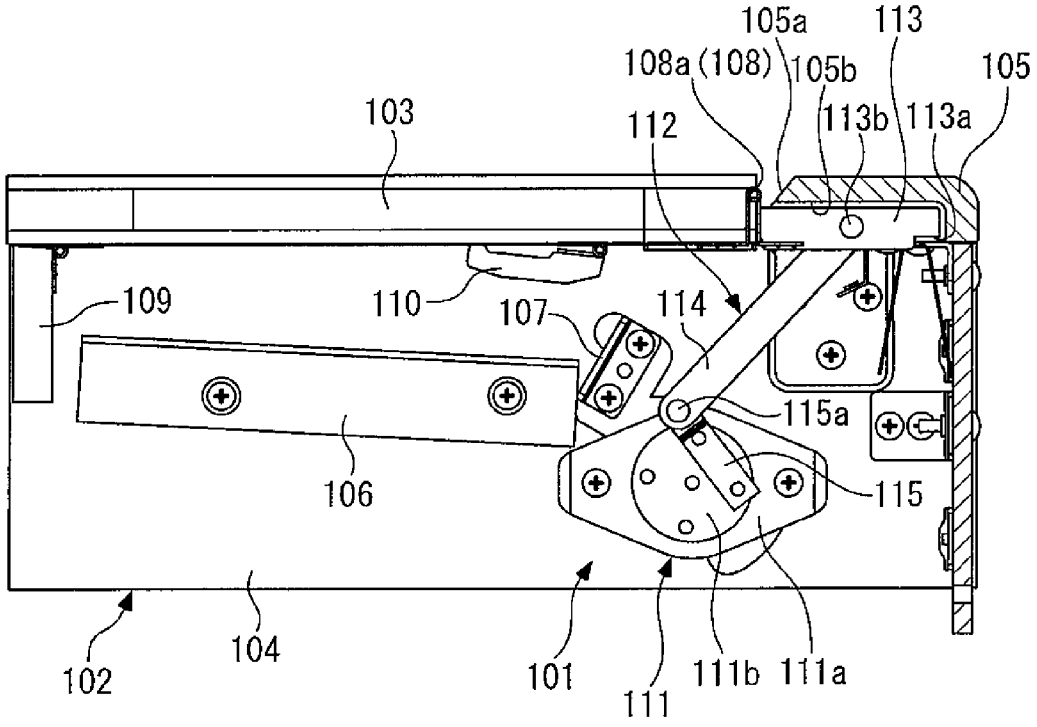
FIG. 3 is a right side view, partly in cross-section, of an electronic piano to which is applied an opening and closing device for a fallboard, according to a second embodiment of the present invention, with the fallboard in a fully closed position.
Figure 4:
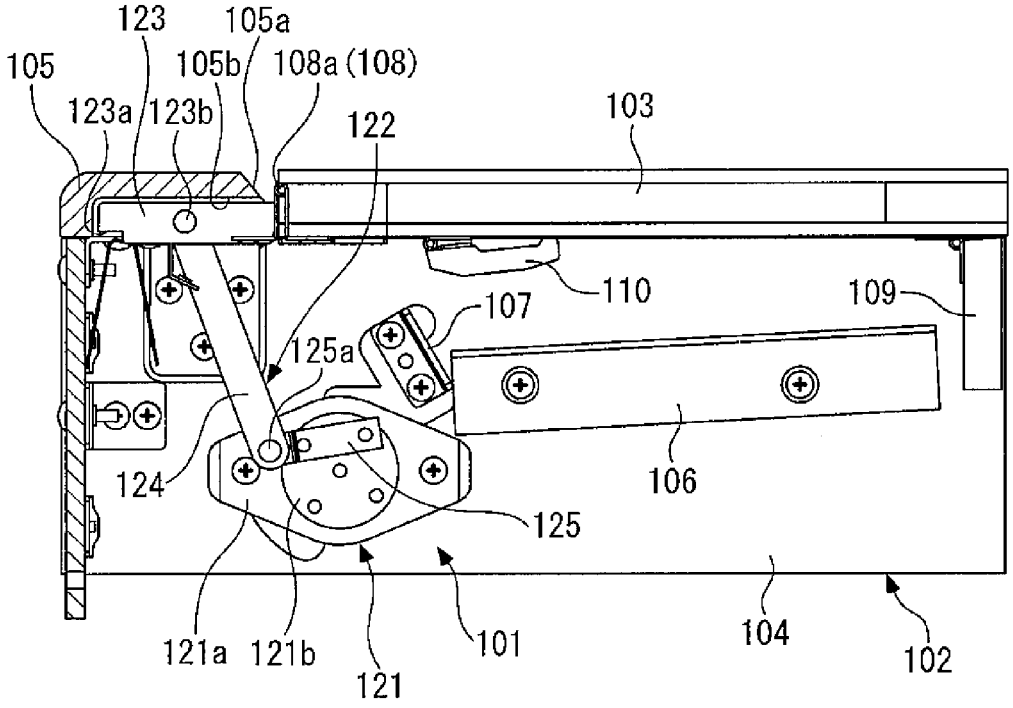
FIG. 4 is a left side view, partly in cross-section, of the electronic piano shown in FIG. 3, with the fallboard in the fully closed position.

Next, a second embodiment of the present invention will be described in detail with reference to drawings. As shown in FIGS. 3 and 4, an electronic piano to which is applied an opening and closing device 101 for a fallboard, according to the present embodiment, is comprised of a piano body 102 for accommodating a keyboard (not shown) etc. and a fallboard 103 for opening and closing the keyboard. In the following description, as viewed from the viewpoint of the player, a near side of the electronic piano (left side as viewed in FIG. 3 and right side as viewed in FIG. 4) will be referred to as "front", and a far side of the same (right side as viewed in FIG. 3 and left side as viewed in FIG. 4) will be referred to as "rear". Further, a left side of the same will be referred to as "left", and a right side of the same will be referred to as "right".

The piano body 102 is integrally formed with arms 104 and 104 erected on the respective left and right ends thereof, and a topboard 105 rigidly secured to rear portions of the upper surfaces of the respective arms 104 and 104. Each of the arms 104 and 104 is erected vertically and extends in the front-rear direction. Rigidly secured to a front portion of an inner surface of each of the arms 104 and 104 is a cheekblock 106, and the keyboard is disposed between the left and right cheekblocks 106 and 106. Further, rigidly secured to a substantially central portion of the inner surface of each of the arms 104 and 104 in the front-rear direction is a stopper 107 for holding the fallboard 103 in the fully open position. The topboard 105 is formed into a laterally elongated rectangular shape in plan view, and has a front end thereof formed with a recess 105*a* for allowing the fallboard 103 to pivotally move to the fully open position (see FIGS. 6 and 8). The recess 105*a* extends in the left-right direction, and is formed into a trapezoidal shape in side view, whose upper end is longer. Further, the topboard 105 has accommodation recesses 105*b* and 105*b* (only one of which is shown in FIGS. 3 to 8) formed in left and right end portions of a lower surface thereof, for accommodating respective first and fourth links 113 and 123, described hereinafter. Each of the accommodation recesses 105*b* extends in the front-rear direction.

The fallboard 103 is formed e.g. by a combination of MDF (medium density fiberboard) and a solid wood material. The fallboard 103 is formed into a laterally elongated rectangular shape in plan view and has a board shape. The fallboard 103 is placed on the left and right arms 104 and 104. Further, the rear end of the fallboard 103 is secured to the topboard 105 via a hinge 108, and the hinge 108 has a pin 108*a* horizontally extending in the left-right direction. The fallboard 103 is pivotally movable about the pin 108*a* of the hinge 108 between the fully closed position shown in FIGS. 3 and 4 and the fully open position shown in FIGS. 6 and 8. When the fallboard 103 is in the fully closed position, the upper surface of the fallboard 103 is held flush with the upper surface of the topboard 105, and the left and right ends of the lower surface of the fallboard 103 are held in contact with the upper surfaces of the respective arms 104 and 104. Further, a front section 109 is attached to the lower surface of the front end of the fallboard 103 via a hinge, and a music rack 110 is attached to the lower surface of the rear end of the fallboard 103 via a hinge.

The opening and closing device 101 is configured to cause a braking force to act on the fallboard 103 so as to properly open or close the fallboard 103. The opening and closing device 101 is comprised of a first rotary damper 111 and a first link mechanism 112 disposed at the left end of the piano body 102 and a second rotary damper 121 and a second link mechanism 122 disposed at the right end of the piano body 102.

The first rotary damper 111 is a so-called hydraulic one-way damper. The first rotary damper 111 is comprised of a body part 111*a* and a first rotor 111*b* provided in the body part 111*a* in a pivotally movable manner. The body part 111*a* is fixedly embedded in a rear portion of the inner surface of the left arm 104. The first rotary damper 111 is configured to cause the first rotor 111*b* to generate a braking force when the first rotor 111*b* is caused to perform clockwise rotation with respect to the body part 111*a* by an external force, and on the other hand, inhibit the first rotor 111*b* from generating a braking force when the first rotor 111*b* is caused to perform counterclockwise rotation with respect to the body part 111*a*.

The first link mechanism 112 is configured not only to transmit a pivotal motion of the fallboard 103 to the first rotor 111*b*, but also to transmit a braking force of the first rotary damper 111 to the fallboard 103. The first link mechanism 112 is formed by a combination of the first link 113, a second link 114, and a third link 115. The first link 113 is formed by a metal strip, and is rigidly secured to the rear end of the left end of the fallboard 103. When the fallboard 103 is in the fully closed position, the first link 113 extends rearward from the fallboard 103 and is accommodated in the accommodation recess 105*b* of the topboard 105. Further, the first link 113 has a cutout 113*a* formed in a rear end thereof and a first pivot 113*b* provided in a central portion thereof.

The second link 114 is formed by a metal strip having a length larger than that of the first link 113. The second link 114 has one end thereof connected to the first pivot 113*b* of the first link 113 and the other end thereof connected to a second pivot 115*a*, described hereinafter, of the third link 115 in a pivotally movable manner, and extends in a vertical direction. The third link 115 is made of a synthetic resin. The third link 115 is formed into a rectangular strip and board shape, and has a length smaller than that of the first link 113. The third link 115 is rigidly secured to the first rotor 111*b* of the first rotary damper 111, and one end of the third link 115 projects outward of the first rotor 111*b*. The above-mentioned second pivot 115*a* is provided in this end.

The positional relationship between the pin 108*a* as the rotation center of the fallboard 103, the first rotary damper 111, and the first and second pivots 113*b* and 115*a*, and the shapes and sizes of the first to third links 113 to 115 are set such that an operation involving the opening or closing of the fallboard 103 can be properly performed. The center of rotation of the first rotor 111*b* is positioned forward of and below the pin 108*a* by the setting of the position of the first rotary damper 111. Further, when the fallboard 103 is in the fully closed position, the first pivot 113*b* is positioned rearward of the pin 108*a* and in approximately the same vertical position as the pin 108*a* is, whereas the second pivot 115*a* is positioned forward of the pin 108*a* and below the first pivot 113*b*. Further, the second link 114 obliquely extends forward from the first pivot 113*b* toward the second pivot 115*a* below the first pivot 113*b*.

The second rotary damper 121 and the second link mechanism 122 are basically disposed in laterally symmetrical relation to the first rotary damper 111 and the first link mechanism 112, respectively, and have the same construction as the first rotary damper 111 and the first link mechanism. 112, respectively. Specifically, the second rotary damper 121 is a hydraulic one-way damper similar to the first rotary damper 111, and has a body part 121*a* and a rotatable second rotor 121*b*. The body part 121*a* is fixedly embedded in a rear portion of the inner surface of the right arm 104. The second rotary damper 121 is configured to cause the second rotor 121*b* to generate a braking force when the second rotor 121*b* is caused to perform clockwise rotation with respect to the body part 121*a* by an external force, and inhibit the second rotor 121*b* from generating a braking force when the second rotor 121*b* is caused to perform counterclockwise rotation with respect to the body part 121*a*.

The second link mechanism 122 is configured not only to transmit a pivotal motion of the fallboard 103 to the second rotor 121*b*, but also to transmit a braking force of the second rotary damper 121 to the fallboard 103. The second link mechanism 122 is formed by a combination of the fourth link 123, a fifth link 124, and a sixth link 125. The fourth link 123 is made of the same material as that of the first link 113 of the first link mechanism 112 and is formed to have the same shape and size as those of the first link 113. The fourth link 123 is rigidly secured to the rear end of the right end of the fallboard 103. When the fallboard 103 is in the fully closed position, the fourth link 123 extends rearward from the fallboard 103 and is accommodated in the accommodation recess 105*b* of the topboard 105. Further, the fourth link 123 has a cutout 123*a* formed in a rear end thereof and a first pivot 123*b* provided in a central portion thereof.

The fifth link 124 is made of the same material as that of the second link 114 of the first link mechanism 112 and is formed to have the same shape and size as those of the second link 114. The fifth link 124 has one end thereof connected to the first pivot 123*b* of the fourth link 123 and the other end thereof connected to a second pivot 125*a*, described hereinafter, of the sixth link 125 in a pivotally movable manner, and extends in a vertical direction. The sixth link 125 is made of the same material as that of the third link 115 of the first link mechanism 112 and is formed to have the same shape and size as those of the third link 115 of the first link mechanism 112. The sixth link 125 is rigidly secured to the second rotor 121*b* of the second rotary damper 121, and one end of the sixth link 125 projects outward of the second rotor 121*b* of the second rotary damper 121. The above-mentioned second pivot 125*a* is provided in this end.

The positional relationship between the pin 108*a*, the second rotary damper 121, and the first and second pivots 123*b* and 125*a*, and the shapes and sizes of the fourth to sixth links 123 to 125 are set such that an operation involving the opening or closing of the fallboard 103, described hereinafter, can be properly performed. The fourth to sixth links 123 to 125 have the same shapes and sizes as those of the first to third links 113 to 115 of the first link mechanism 112, as described hereinbefore, respectively. Further, as is apparent from a comparison between FIGS. 4 and 3, the center of rotation of the second rotor 121*b* is in symmetrical relation to the center of rotation of the first rotor 111*b* and is positioned forward of and below the pin 108*a*. Further, the position of the first pivot 123*b* is in symmetrical relation to that of the first pivot 113*b* of the first link mechanism 112, and when the fallboard 103 is in the fully closed position, the first pivot 123*b* is positioned rearward of the pin 108*a* and in approximately the same vertical position as the pin 108*a* is.

On the other hand, the position of the second pivot 125*a* is not in symmetrical relation to that of the second pivot 115*a* of the first link mechanism 112. Specifically, when the fallboard 103 is in the fully closed position, the second pivot 125*a* is in approximately the same position in the front-rear direction as the pin 108*a* and below the first pivot 123*b*, and is positioned rearward of and below the second pivot 115*a* of the first link mechanism 112. The fifth link 124 obliquely extends forward from the first pivot 123*b* toward the second pivot 125*a* below the first pivot 123*b*. The angle of the fifth link 124 with respect to the fourth link 123 is set larger than that of the second link 114 of the first link mechanism 112 with respect to the first link 113 of the same.

Figure 5:
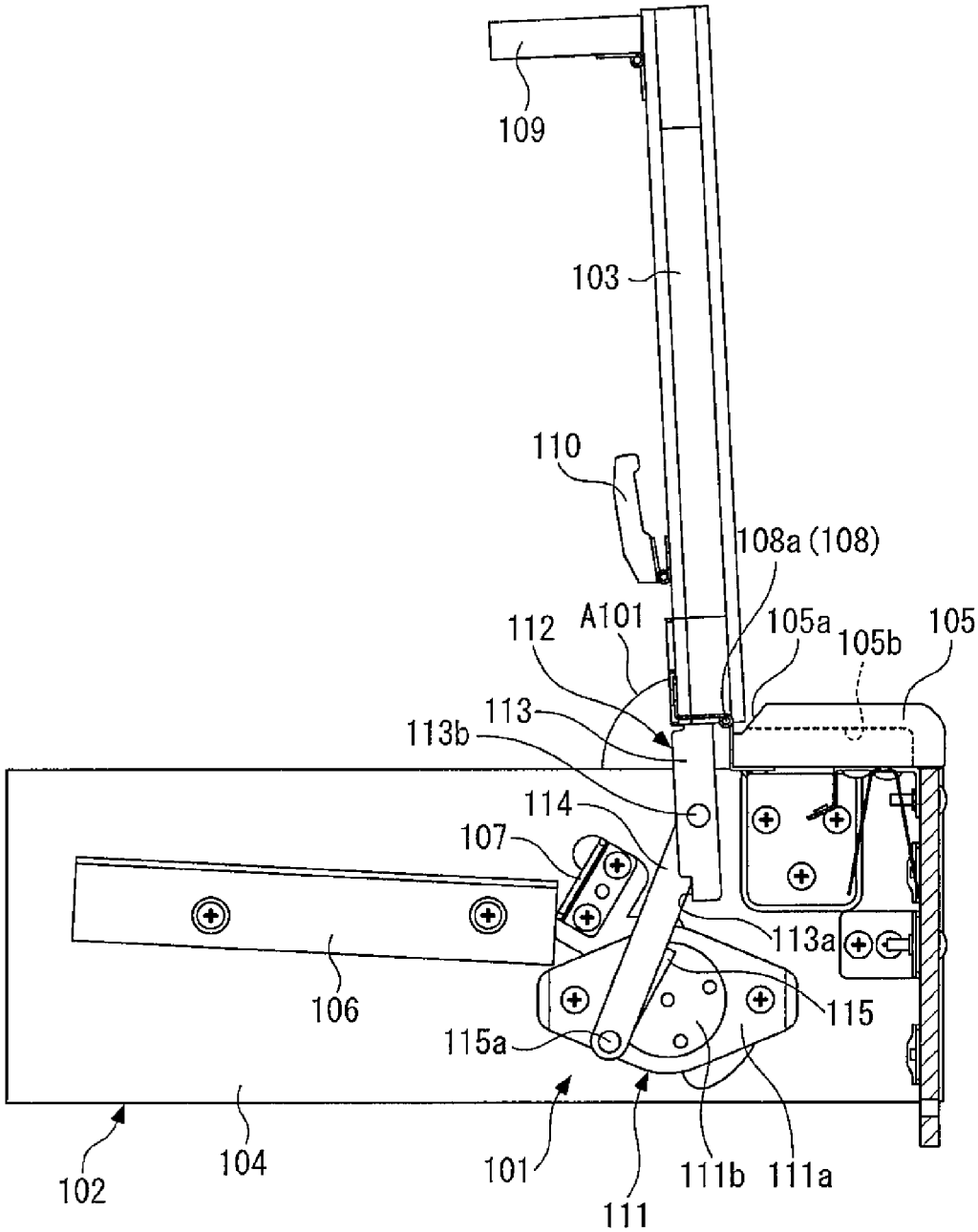
FIG. 5 is a right side view, partly in cross-section, of the electronic piano shown in FIG. 3, with the fallboard in a first opening position.

Next, with reference to FIGS. 3, 5, and 6, a description will be given of how the first rotary damper 111 and the first link mechanism 112 operate when the fallboard 103 is opened and closed. As the fallboard 103 pivotally moves from the fully closed position (see FIG. 3) toward a predetermined first opening position shown in FIG. 5, the first link 113 pivotally moves along with the fallboard 103 in accordance with the pivotal motion thereof, and the second link 114 obliquely moves downward and forward along with the first pivot 113*b* of the first link 113 and the second pivot 115*a* of the third link 115 while pivotally moving about the two pivots 113*b* and 115*a*. As a consequence, the first rotor 111*b* integrally connected to the third link 115 rotates in the counterclockwise direction with respect to the body part 111*a*.

As described hereinbefore, the first rotary damper 111 is configured to inhibit the first rotor 111*b* from generating a braking force when the first rotor 111*b* is performing counterclockwise rotation. Therefore, the braking force of the first rotary damper 111 is not generated during the pivotal motion of the fallboard 103 from the fully closed position toward the first opening position. Further, a first opening degree A1 as an opening degree of the fallboard 103 in the first opening position is set e.g. to approximately 87 degrees. The reason for this will be described hereinafter. When the fallboard 103 is in the first opening position, the pin 108*a* and the first and second pivots 113*b* and 115*a* are positioned on the same straight line.

Figure 6:
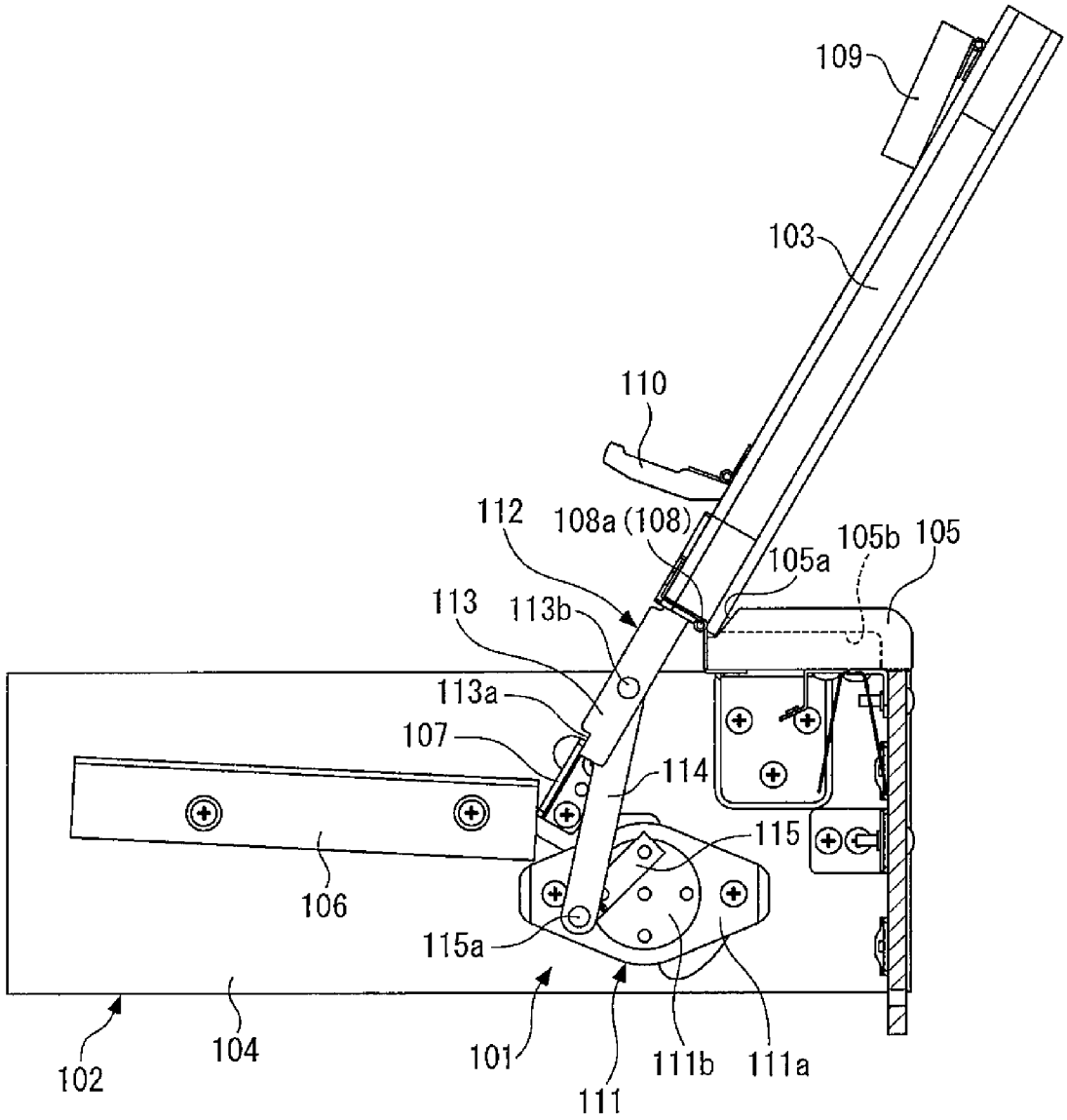
FIG. 6 is a right side view, partly in cross-section, of the electronic piano shown in FIG. 3, with the fallboard in a fully open position.

As the fallboard 103 pivotally moves from the first opening position (see FIG. 5) toward the fully open position shown in FIG. 6, the first link 113 pivotally moves along with the fallboard 103 in accordance with the pivotal motion thereof, and the second link 114 obliquely moves upward and forward along with the first pivot 113*b* and the second pivot 115*a* while pivotally moving about the two pivots 113*b* and 115*a*. As a consequence, the first rotor 111*b* rotates in the clockwise direction with respect to the body part 111*a*. The first rotary damper 111 is configured to cause the first rotor 111*b* to generate a braking force when the first rotor 111*b* is performing clockwise rotation, as described hereinbefore. Therefore, during the pivotal motion of the fallboard 103 from the first opening position toward the fully open position, the braking force of the first rotary damper 111 is transmitted to the fallboard 103 via the first link mechanism 112.

When the fallboard 103 is in the fully open position, the aforementioned cutout 113*a* of the first link 113 is held in contact with the rear surface of the stopper 107 from behind, whereby the fallboard 103 is held in the fully open position. Further, in this state, the rear end of the fallboard 103 is held in contact with the recess 105*a* of the topboard 105, with the front section 109 folded into contact with the fallboard 103 and with the music rack 110 erected.

When the fallboard 103 pivotally moves from the fully open position toward the first opening position, an operation reverse to the operation described above with reference to FIGS. 5 and 6 is performed. As a consequence, the first rotor 111*b* performs counterclockwise rotation, and therefore the braking force of the first rotary damper 111 is not generated. Further, when the fallboard 103 pivotally moves from the first opening position toward the fully closed position, an operation reverse to the operation described above with reference to FIGS. 3 and 5 is performed. As a consequence, the first rotor 111*b* performs clockwise rotation, and therefore the braking force of the first rotary damper 111 is generated and transmitted to the fallboard 103 via the first link mechanism 112.

Figure 7:
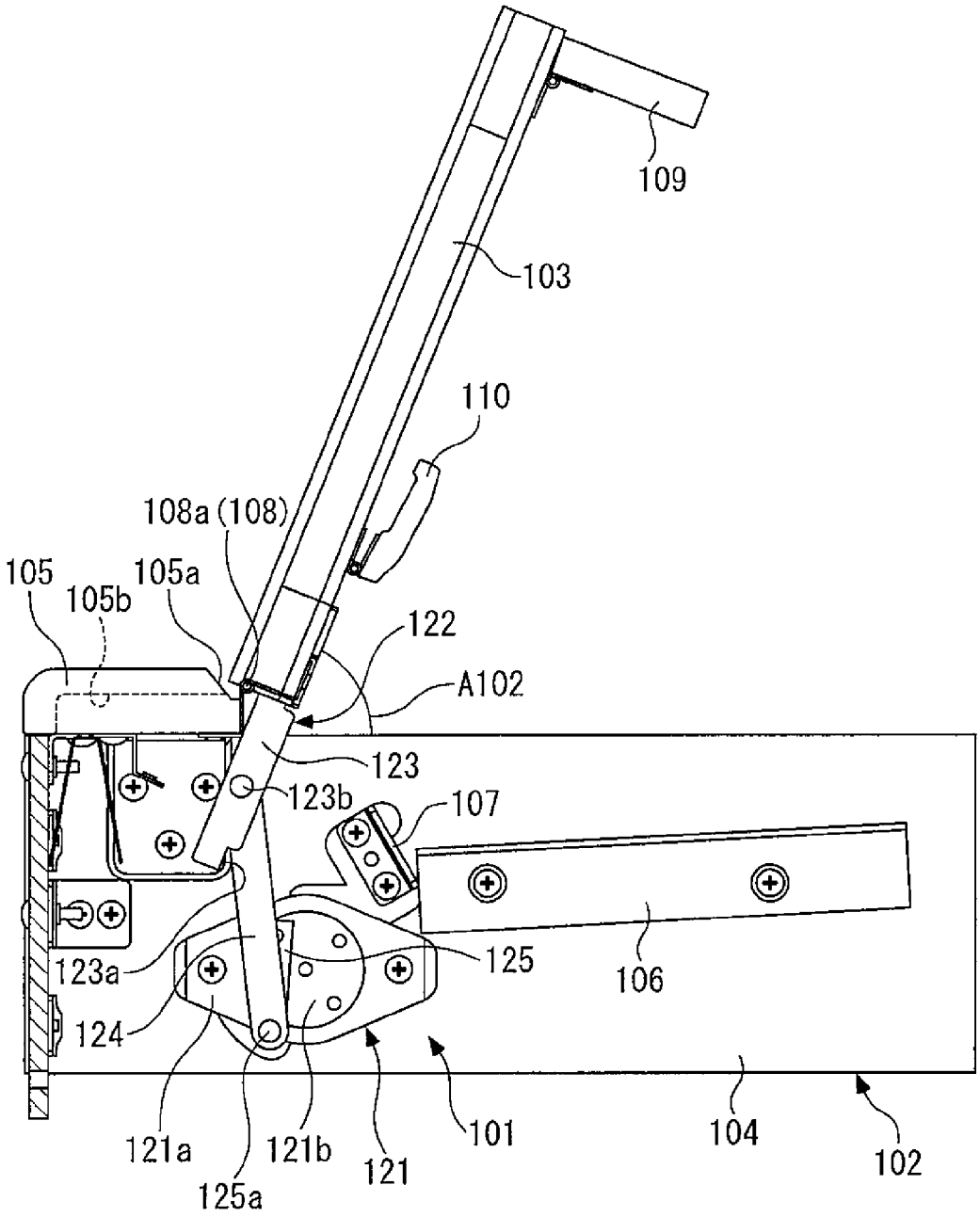
FIG. 7 is a left side view, partly in cross-section, of the electronic piano shown in FIG. 3, with the fallboard in a second opening position.

Next, with reference to FIGS. 4, 7, and 8, a description will be given of how the second rotary damper 121 and the second link mechanism 122 operate when the fallboard 103 is opened and closed. When the fallboard 103 pivotally moves from the fully closed position (see FIG. 4) toward a predetermined second opening position shown in FIG. 7, the fourth link 123 pivotally moves along with the fallboard 103, and the fifth link 124 obliquely moves downward and forward along with the first pivot 123*b* of the fourth link 123 and the second pivot 125*a* of the sixth link 125 while pivotally moving about the two pivots 123*b* and 125*a*. As a consequence, the second rotor 121*b* integrally connected to the sixth link 125 rotates in the counterclockwise direction with respect to the body part 121*a*.

As described hereinbefore, the second rotary damper 121 is configured to inhibit the second rotor 121*b* from generating a braking force when the second rotor 121*b* is performing counterclockwise rotation. Therefore, the braking force of the second rotary damper 121 is not generated during the pivotal motion of the fallboard 103 from the fully closed position toward the second opening position. Further, a second opening degree A2 as an opening degree of the fallboard 103 in the second opening position is set to a smaller opening degree than the aforementioned first opening degree A1, e.g. to approximately 70 degrees. The reason for this will be described hereinafter. When the fallboard 103 is in the second opening position, the pin 108*a* and the first and second pivots 123*b* and 125*a* are positioned on the same straight line.

Figure 8:
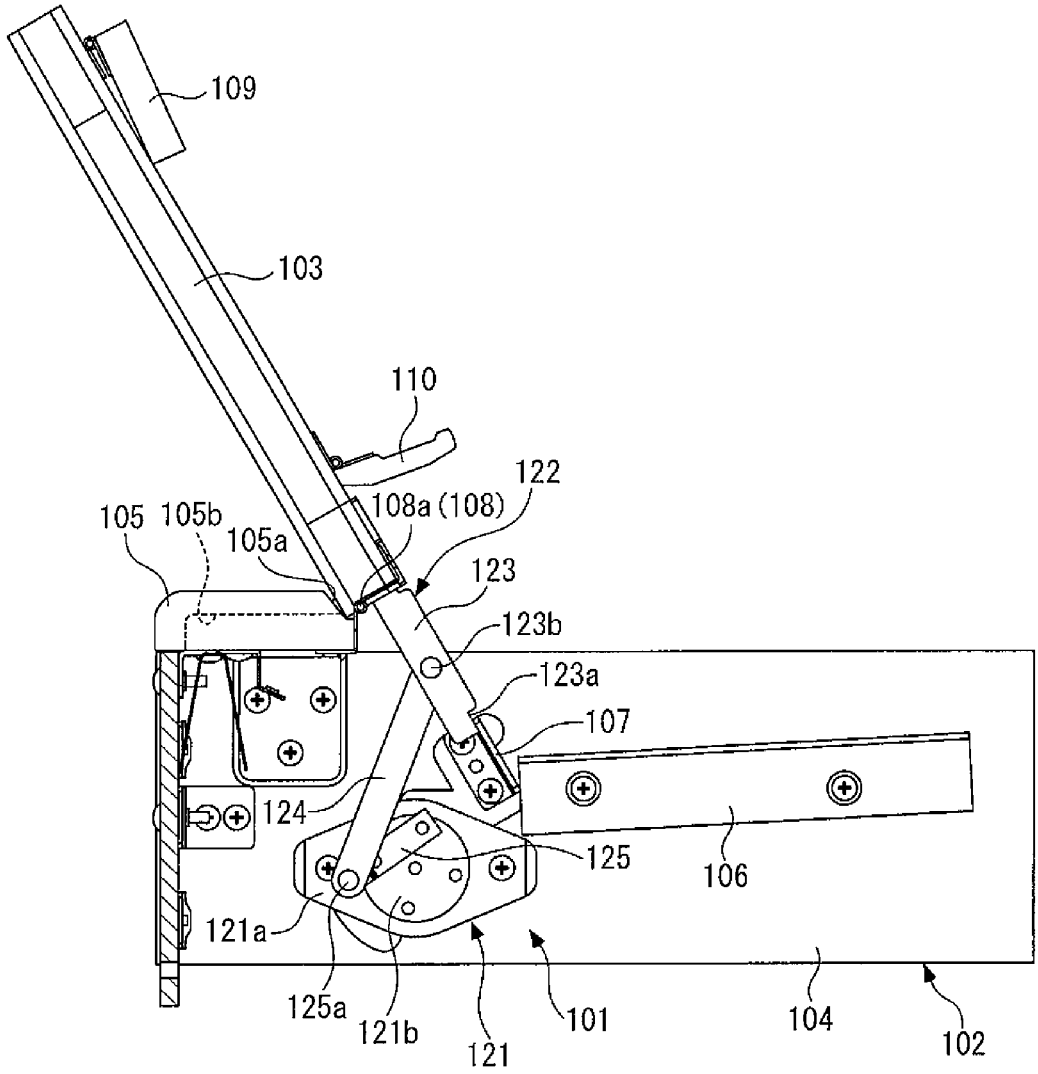
FIG. 8 is a left side view, partly in cross-section, of the electronic piano shown in FIG. 3, with the fallboard in the fully open position.
Figure 9A:
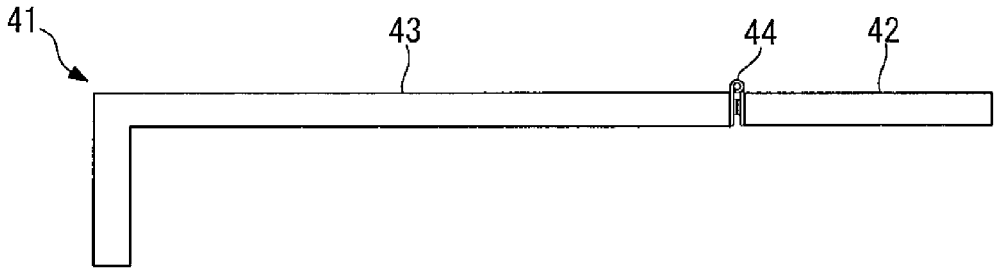
FIG. 9A RELATED ART
Figure 9B:
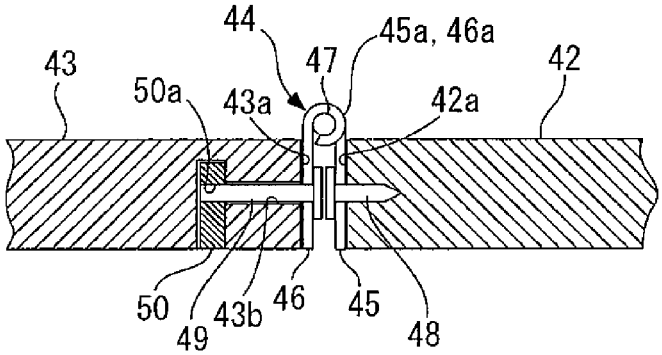
FIG. 9B RELATED ART
Figure 10:
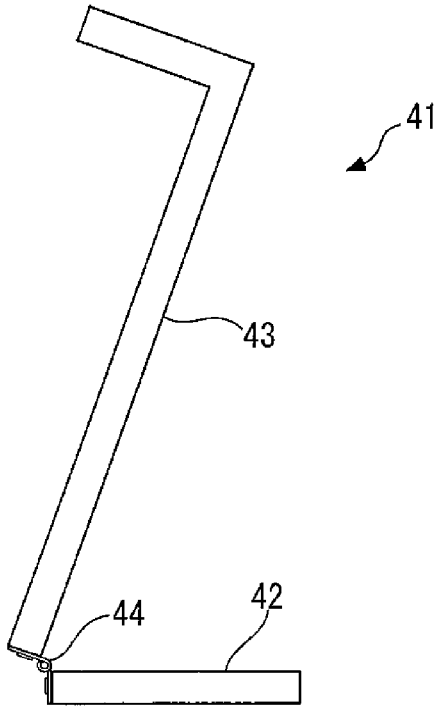
FIG. 10 RELATED ART
FIG. 10 is a schematic view of the fallboard arrangement shown in FIGS. 9A and 9B, with a fallboard open.

As the fallboard 103 pivotally moves from the second opening position (see FIG. 7) toward the fully open position shown in FIG. 8, the fourth link 123 pivotally moves along with the fallboard 103 in accordance with the pivotal motion thereof, and while the fifth link 124 pivotally moves about the first and second pivots 123*b* and 125*a*, an upper half thereof obliquely moves upward and forward along with the first pivot 123*b* and a lower half thereof obliquely moves upward and rearward along with the second pivot 125*a*. As a consequence, the second rotor 121*b* rotates in the clockwise direction with respect to the body part 121*a*. The second rotary damper 121 is configured to cause the second rotor 121*b* to generate a braking force during clockwise rotation thereof, as described hereinbefore. Therefore, during the pivotal motion of the fallboard 103 from the second opening position toward the fully open position, the braking force of the second rotary damper 121 is transmitted to the fallboard 103 via the second link mechanism 122.

Further, when the fallboard 103 pivotally moves from the fully open position toward the second opening position, an operation reverse to the operation described above with reference to FIGS. 7 and 8 is performed. As a consequence, the second rotor 121*b* performs counterclockwise rotation, and therefore the braking force of the second rotary damper 121 is not generated. Further, when the fallboard 103 pivotally moves from the second opening position toward the fully closed position, an operation reverse to the operation described above with reference to FIGS. 4 and 7 is performed. As a consequence, the second rotor 121*b* performs clockwise rotation, and therefore the braking force of the second rotary damper 121 is generated and transmitted to the fallboard 103 via the second link mechanism 122.

As described above, according to the above-described embodiment, each of the first and second rotary dampers 111 and 121 is configured to cause the associated one of the rotors 111*b* and 121*b* to generate a braking force during clockwise rotation thereof. Further, the first link mechanism 112 is connected to the fallboard 103 and the first rotor 111*b*, and along with pivotal motion of the fallboard 103, the first link mechanism 112 causes the first rotor 111*b* to rotate in the clockwise direction when the fallboard 103 pivotally moves from the first opening position toward the fully open position or from the first opening position toward the fully closed position. Similarly, the second link mechanism 122 is connected to the fallboard 103 and the second rotor 121*b*, and along with pivotal motion of the fallboard 103, the second link mechanism 122 causes the second rotor 121*b* to rotate in the clockwise direction when the fallboard 103 pivotally moves from the second opening position, where the degree of opening of the fallboard 103 is set smaller than that in the first opening position, toward the fully open position or from the second opening position toward the fully close position.

Further, as is apparent from the operation performed by the opening and closing device 101 when the fallboard 103 is opened and closed, neither of the braking forces of the respective first and second rotary dampers 111 and 121 acts on the fallboard 103 during pivotal motion of the fallboard 103 from the fully closed position toward the second opening position. Further, during pivotal motion of the fallboard 103 from the second opening position toward the first opening position, only the braking force of the second rotary damper 121 acts, and during pivotal motion of the fallboard 103 from the first opening position toward the fully open position, not only the braking force of the second rotary damper 121, but also the braking force of the first rotary damper 111 acts. On the other hand, during pivotal motion of the fallboard 103 from the fully open position toward the first opening position, neither of the braking forces of the respective first and second rotary dampers 111 and 121 acts on the fallboard 103. Further, during pivotal motion of the fallboard 103 from the first opening position toward the second opening position, only the braking force of the first rotary damper 111 acts, and during pivotal motion of the fallboard 103 from the second opening position toward the fully closed position, not only the braking force of the first rotary damper 111, but also the braking force of the second rotary damper 121 acts.

As described above, differently from the prior art, it is possible to cause the two braking forces from the respective first and second rotary dampers 111 and 121 to act on the fallboard 103 immediately before the fallboard 103 is fully opened or closed, and hence the fallboard 103 can be fully braked. This makes it possible to prevent the fallboard 103 from coming into strong collision with the topboard 105 and the arms 104 and 104, and the first and fourth links 113 and 123 from coming into strong collision with the stopper 107. In doing this, the braking forces of the respective first and second rotary dampers 111 and 121 are not both caused to act on the fallboard 103 from the start of the opening or closing operation of the fallboard 103, but only one of the two braking forces is caused to act first, and then both the two braking forces are caused to act. This enables stepwise increase of the braking force acting on the fallboard 103 e.g. even when the fallboard 103 is abruptly opened or closed, thereby making it possible to prevent breakage of the fallboard 103 and/or the first and second link mechanisms 112 and 122 due to sudden action of a very large braking force caused by the abrupt opening or closing operation.

Further, neither of the braking forces of the respective first and second rotary dampers 111 and 121 is caused to act on the fallboard 103 at the start of the opening or closing operation of the fallboard 103, and hence the opening or closing operation of the fallboard 103 can be performed smoothly. The above-described advantageous effects can be obtained by using general one-way dampers for the first and second rotary dampers 111 and 112, instead of using expensive rotary dampers capable of changing their braking forces.

As is apparent from the opening operation of the fallboard 103 described with reference to FIGS. 3 to 8, the fallboard 103 has to be lifted open against gravity at the start of the opening operation of the fallboard 103. Further, when the degree of opening of the fallboard 103 exceeds 90 degrees during the opening operation of the fallboard 103, gravity acts to cause the fallboard 103 to pivotally move toward the fully open position.

According to the present embodiment, however, the second opening degree A2 (second opening position) of the fallboard 103 at which the braking force of the second rotary damper 121 starts acting during the opening operation of the fallboard 103 is set to 70 degrees close to 90 degrees. Also, the first opening degree A1 (first opening position) at which the braking forces of the respective first and second rotary dampers 111 and 121 both start acting during the opening operation of the fallboard 103 is set to 87 degrees. Further, the first and second opening degrees A1 and A2 are set empirically e.g. by experiment to the respective angles that make it possible to obtain the braking forces of the respective first and second rotary dampers 111 and 121 in a well-balanced manner during the opening operation of the fallboard 103. From the above, it is possible to effectively obtain the advantageous effect that the initial operation for opening the fallboard 103 can be performed smoothly and the advantageous effect that collision of the fallboard 103 against the topboard 105 can be prevented.

On the other hand, as is apparent from the closing operation of the fallboard 103 described with reference to FIGS. 3 to 8, before the degree of opening of the fallboard 103 reaches approximately 90 degrees during the closing operation of the fallboard 103, gravity acts to cause the fallboard 103 to pivotally move toward the fully open position. Then, when the degree of opening of the fallboard 103 becomes smaller than approximately 90 degrees during the closing operation of the fallboard 103, gravity acts to cause the fallboard 103 to pivotally move toward the fully closed position.

According to the present embodiment, however, the first opening degree A1 of the fallboard 103 at which the braking force of the first rotary damper 111 starts acting during the closing operation of the fallboard 103 is set to 87 degrees. Also, the second opening degree A2 at which the braking forces of the respective first and second rotary dampers 111 and 121 both start acting during the closing operation of the fallboard 103 is set to 70 degrees. Further, the first and second opening degrees A1 and A2 are set empirically e.g. by experiment to the respective angles that make it possible to obtain the braking forces of the respective first and second rotary dampers 111 and 121 in a well-balanced manner during the closing operation of the fallboard 103. From the above, it is possible to effectively obtain the advantageous effect that the initial operation for closing the fallboard 103 can be performed smoothly and the advantageous effect that collision of the fallboard 103 against the arms 104 and 104 can be prevented.

Furthermore, the first and second rotary dampers 111 and 121 have the same construction, and each pair of the first link 113 and the fourth link 123, the second link 114 and the fifth link 124, and the third link 115 and the sixth link 125 each have the same shape and size. This makes it possible to reduce the manufacturing costs of the opening and closing device 101.

Note that the present invention is by no means limited to the above-described embodiments, but it can be practiced in various forms. For example, in the above-described second embodiment, the first rotary damper 111 and the first link mechanism 112 are disposed at the left end of the piano body 102, and the second rotary damper 121 and the second link mechanism 122 are disposed at the right end of the same, but this arrangement may be inversed such that the first rotary damper 111 and the first link mechanism 112 are disposed at the right end of the piano body 102, and the second rotary damper 121 and the second link mechanism 122 are disposed at the left end of the same. Alternatively, the four component parts 111, 112, 121, and 122 may be disposed in other appropriate areas of the piano body 102, respectively. For example, the first and second rotary dampers 111 and 121 and the first and second link mechanisms 112 and 122 may be collectively arranged in the left area (or the right area) of the piano body 102.

Although in the second embodiment, each of the first and second rotary dampers 111 and 121 is implemented by a hydraulic one-way damper, it is possible to use an appropriate type of one-way damper. Further, although in the second embodiment, each of the first and second rotary dampers 111 and 121 is configured to cause the associated one of the first and second rotors 111*b* and 121*b* to generate a braking force when the associated one is performing clockwise rotation, the directions of rotation of the first and second rotors 111*b* and 121*b* (first and second directions) during which the braking forces are generated may be counterclockwise. Furthermore, in the second embodiment, the first and second rotary dampers 111 and 121 have the same construction, but the first and second rotary dampers 111 and 121 may be implemented by respective rotary dampers different from each other in braking force or by respective rotary dampers each capable of changing a braking force. Moreover, although in the second embodiment, the first link 113 and the fourth link 123, the second link 114 and the fifth link 124, and the third link 115 and the sixth link 125 are formed as respective pairs each formed of the same material, the links of each pair may be formed of respective different materials.

In the second embodiment, the second opening position is set to a position where the degree of opening of the fallboard 103 is smaller than in the first opening position, by making the position of the second pivot 125*a* with respect to the first pivot 123*b* of the second link mechanism 122 and the pin 108*a* different from that of the second pivot 115*a* of the first link mechanism 112. However, the second opening position may be set e.g. by forming at least one pair of the first link 113 and the fourth link 123, the second link 114 and the fifth link 124, and the third link 115 and the sixth link 125 such that the two links differ from each other in shape and size, by making the position of the first pivot 113*b* with respect to the second pivot 115*a* of the first link mechanism 112 and the pin 108*a* different from that of the first pivot 123*b* of the second link mechanism 122, or by disposing the first and second rotary dampers 111 and 112 such that they differ from each other in positional relationship with the pin 108*a*. In this case, it is to be understood that the setting method employed in the second embodiment can be combined with any of the above-mentioned three setting methods as deemed appropriate.

Further, although in the second embodiment, the first and second opening degrees A1 and A2 of the respective first and second opening positions are set to 87 degrees and 70 degrees, respectively, the first and second opening degrees A1 and A2 may be set to other appropriate values. Furthermore, although in the second embodiment, the first and second link mechanisms 112 and 122 each of which is formed to have three links are used, it is possible to use other link mechanisms having an appropriate construction. Although in the second embodiment, the opening and closing device 101 of the present invention is applied to an electronic piano, this is not limitative, but the present invention can be applied to any other keyboard instrument having a keyboard, such as a grand piano, an upright piano, or an electronic organ.

It is further understood by those skilled in the art that the foregoing are preferred embodiments of the invention, and that various changes and modifications may be made without departing from the spirit and scope thereof.

What is claimed is:

1. A fallboard arrangement for a keyboard instrument, which is disposed in an upper part of a musical instrument body having a performance section including a keyboard, so as to close the performance section into a covered state and open the performance section into an exposed state, comprising:

a fallboard back section that is formed to have a board shape, and is immovably provided in a rear part of the musical instrument body, in a horizontal state;

a fallboard that is movable between a closed position where said fallboard is positioned forward of said fallboard back section and has an upper surface thereof made flush with an upper surface of said fallboard back section in a state closing the performance section, and an open position where said fallboard is positioned upward of said fallboard back section and opens the performance section; and a hinge that connects said fallboard to said fallboard back section such that said fallboard can pivotally move between the closed position and the open position, wherein said hinge is disposed downward of said fallboard in the closed position and the upper surface of said fallboard back section.

2. The keyboard arrangement according to claim 1, wherein said hinge includes:

a fallboard back section-side fixed plate that is rigidly secured to a front end face and lower surface continuous therewith of said fallboard back section, a fallboard-side fixed plate that is rigidly secured to a fallboard back section-side end face and lower surface continuous therewith of said fallboard, and a connection shaft that extends horizontally, and connects said fallboard back section-side fixed plate and said fallboard-side fixed plate in a manner pivotally movable with respect to each other, and wherein a fallboard back section-side end of said fallboard is provided with a cover part which is formed in a manner continuous with the upper surface of said fallboard and protruding toward said fallboard back section, said cover part being configured to cover, when said fallboard is in the closed position, from above a portion of said fallboard back section-side fixed plate and a portion of said fallboard-side fixed plate which are connected to each other by said connection shaft.

3. The keyboard arrangement according to claim 2, wherein said fallboard back section has a recess provided in an upper portion of a front end thereof, said recess being so cut out as to avoid interference of said fallboard back section with said cover part during pivotal motion of said fallboard toward the open position.

4. An opening and closing device for a fallboard, for opening and closing a fallboard that is attached to a musical instrument body in a manner pivotally movable between a fully open position for opening a keyboard and a fully closed position for closing the keyboard, comprising:

a first rotary damper that has a rotatable first rotor, and is provided in the musical instrument body, said first rotary damper being configured to cause said first rotor to generate a braking force only during rotation of the first rotor in a predetermined first direction;

a first link mechanism that is connected to the fallboard and said first rotor, and is configured to cause said first rotor to rotate in the first direction in accordance with pivotal motion of the fallboard when the fallboard pivotally moves from a predetermined first opening position between the fully open position and the fully closed position toward the fully open position or when the fallboard pivotally moves from the first opening position toward the fully closed position, a second rotary damper that has a rotatable second rotor, and is provided in the musical instrument body, said second rotary damper being configured to cause said second rotor to generate a braking force only during rotation of said second rotor in a predetermined second direction; and a second link mechanism that is connected to the fallboard and said second rotor, and is configured to cause said second rotor to rotate in the second direction in accordance with pivotal motion of the fallboard when the fallboard pivotally moves from a predetermined second opening position between the fully open position and the fully closed position, where an opening degree of the fallboard is smaller than in the first opening position, toward the fully open position or when the fallboard pivotally moves from the second opening position toward the fully closed position.

5. The fallboard opening and closing device according to claim 4, wherein said first link mechanism includes a first link rigidly secured to the fallboard, a second link pivotally connected to said first link, and a third link pivotally connected to said second link and rigidly secured to said first rotor, wherein said second link mechanism includes a fourth link rigidly secured to the fallboard, a fifth link pivotally connected to said fourth link, and a sixth link pivotally connected to said fifth link and rigidly secured to said second rotor, wherein each pair of said first link and said fourth link, said second link and said fifth link, and said third link and said sixth link are configured to each have the same shape and size, and wherein said first and second rotary dampers have the same construction.

* * * * *